United States Patent [19]

Criscimagna et al.

[11] 4,017,762

[45] Apr. 12, 1977

[54] VOLTAGE CONTROLLED SUSTAIN FREQUENCY IN A GAS DISPLAY PANEL

[75] Inventors: Tony Nick Criscimagna, Woodstock; Michael J. Steinmetz, Hurley, both of N.Y.

[73] Assignee: IBM Corporation, Armonk, N.Y.

[22] Filed: Mar. 30, 1976

[21] Appl. No.: 671,765

Related U.S. Application Data

[63] Continuation of Ser. No. 529,309, Dec. 4, 1974, abandoned.

[52] U.S. Cl. ..... 315/169 TV; 315/169 R

[51] Int. Cl.[2] ..... H05B 43/00; H05B 41/00; H05B 41/30

[58] Field of Search ..... 315/169 T, 169 TV

[56] References Cited

UNITED STATES PATENTS

| | | | |
|---|---|---|---|
| 3,801,863 | 4/1974 | Lee | 315/169 TV |
| 3,839,657 | 10/1974 | Nakayama et al. | 315/169 TV |
| 3,843,905 | 10/1974 | Leuck et al. | 315/169 TV |

*Primary Examiner*—Robert Segal

*Attorney, Agent, or Firm*—W. S. Robertson

[57] ABSTRACT

A circuit for supplying sustain voltage pulses to the orthogonal conductors of a gas display panel including voltage sensors to sense any change in sustain voltage amplitude with aging of the circuits and a voltage controlled oscillator to shift the operating frequency of sustain pulses as the amplitude changes. In that manner, the operating point of sustain voltage vs. frequency is shifted to take advantage of the slope in a graphical representation of sustain voltage margin to allow for shifting of the margin due to panel aging.

3 Claims, 4 Drawing Figures

28
29
30
31
32

WRITE ERASE CIRCUITS VERT.
SELECTION CIRCUITS VERT.
SELECTION CIRCUITS
WRITE ERASE CIRCUITS
CONTROL LOGIC
VOLTAGE CONTROLLED OSCILLATOR
DATA SOURCE
VOLTAGE SENSOR
VOLTAGE SENSOR
POWER SUPPLY
H1
H2
HN
V1
V2
VM
15
16
17
18
19
20
21
22
23
24
25
26
27

VOLTAGE CONTROLLED SUSTAIN FREQUENCY IN A GAS DISPLAY PANEL

This is a continuation, of application Ser. No. 529,309 filed Dec. 4, 1974, now abandoned.

This invention relates to gas display panels and more particularly to circuits for adjusting the frequency of sustain voltage pulses in a gas display panel.

BACKGROUND OF THE INVENTION

Gas display panels of the type to which this invention relates have two flat glass plates that are spaced apart by a seal to contain an ionizable medium. A set of horizontally extending insulated conductors are located on one glass plate, and a set of vertically extending conductors are located on the other plate. When a suitable voltage is applied between one horizontal conductor and one vertical conductor, ionization occurs in a region at the cross over point of the two conductors and light is emitted. The cross over points and ionized regions inbetween are called cells, and a display pattern is formed by ionizing selected cells. However, upon application of the firing voltage the cell ionizes and emits light only briefly as free charges formed by the ionization migrate to the insulating glass walls of the cell where these charges produce an opposing voltage to the applied voltage and thereby extinguishes the ionization. The operation of initially ionizing a cell is called writing. Once a cell has been written a continuous sequence of light flashes can be produced by an alternating voltage called a "sustain" voltage. The amplitude of the sustain waveform can be made less than the amplitude required for the firing voltage, because the wall charges that remain from the preceding write or sustain operation produce a voltage that adds to the voltage of the sustain waveform to produce the ionizing voltage. A previously unwritten (or erased) cell is not ionized by the sustain waveform. In a gas panel of this type the sustain waveform is applied across all the horizontal conductors and all of the vertical conductors so that the gas panel maintains a previously written pattern of light emitting cells. The circuits that produce the sustain voltage are called "sustain circuits."

For a conventional write operation a suitable write voltage pulse is added to the sustain voltage waveform so that the combination of the write pulse and the sustain pulse produces ionization. In order to write an individual cell independently, each of the horizontal and vertical conductors has an individual selection circuit. Thus, applying a sustain waveform across all of the horizontal and vertical conductors but applying a write pulse across only one horizontal conductor and one vertical conductor will produce a write operation in only the one cell at the intersection of the selected horizontal and vertical conductors. An erase operation can be thought of as a write operation that proceeds only far enough to allow the previously charged cell walls to discharge, it is closely similar to the write operation except for timing and amplitude, and the circuits that produce both the write or erase pulses are called "write-erase circuits."

The selection circuit usually comprises a transistor switch for each horizontal conductor and each vertical conductor. The horizontal and vertical selection circuits connect the associated conductors to the horizontal or vertical sustain waveform and to a selected one of the two voltage levels of a write-erase pulse.

Gas display panels may be comprised of thousands of individual cells. Each one of these cells requires a minimum sustain voltage level in order to maintain a written condition. Also, each of these cells is limited to a maximum sustain voltage level above which an unselected cell would be written. The difference between the maximum sustain voltage level and the minimum sustain voltage level is called the sustain voltage "margin" or "window." The margin of an entire gas display panel is the difference between the largest minimum voltage level of any cell in the panel and the lowest maximum voltage level of any cell in the panel. Unfortunately, it has been found that the margin shifts upward or downward and often decreases in size as the panel ages.

The drift of a predetermined operating voltage setting due to the aging of the circuits that produce that voltage is a well known problem in electronic circuits. The circuits which produce the sustain voltage in a gas display panel are subject to aging and as a consequence the predetermined sustain voltage level changes as the circuit ages. If the operating voltage initially set in the middle of the margin tends to drift, and the minimum sustain voltage tends to drift in an opposite direction, the panel loses its useful life much quicker than it theoretically should. Thus, it is the object of this invention to extend the useful life of the panel by shifting the sustain voltage frequency as a function of sustain voltage amplitude.

SUMMARY OF THE INVENTION

It has been found that the minimum and maximum sustain voltage levels which determine the margin, vary directly as a function of operating frequency, thus providing a slope to the graphical representation of margin vs. frequency. In recognition thereof, a circuit has been provided in this invention which adjusts the operating frequency of a gas display panel as the sustain voltage level changes with the age of the sustain voltage circuits. To do this a voltage sensing circuit is provided to sense sustain voltage levels to provide basis for adjusting the frequency output of a voltage controlled oscillator. Such an adjustment tends to compensate for aging in the panel by utilizing the slope of voltage vs. frequency.

BRIEF DESCRIPTION OF THE DRAWINGS

The foregoing and other objects, features and advantages of the invention will be apparent from the following detailed description of a preferred embodiment of the invention as illustrated in the accompanying drawings wherein.

DETAILED DESCRIPTION

A gas display panel may be made up of thousands of individual cells with each cell being formed by the orthogonal conductors comprising a grid network across the panel. Each of these cells has a particular voltage level below which a cell cannot be written. Thus, the initial firing voltage must exceed that particular voltage level in order to write the cell, and the sustain voltage together with the wall charge must exceed that voltage in order to maintain the selected written cell. On the other hand, the sustain voltage alone may not exceed that particular voltage level or else an unselected cell will be written. To state another way, each cell has a maximum sustain voltage level which may not be exceeded without firing an unselected cell.

Figure 1:
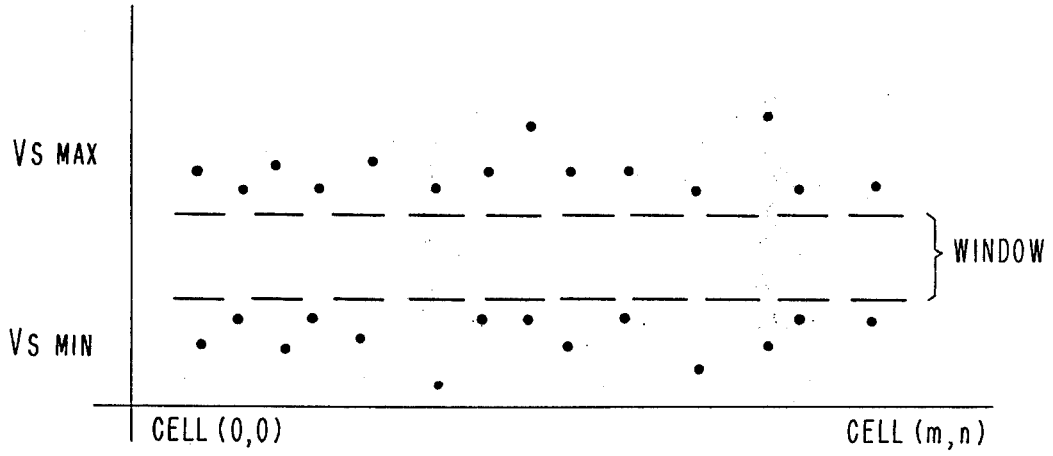
FIG. 1 is a graphical representation of sustain voltage maximum and minimum levels for each cell in a gas display panel.

Conversely, each one of the thousands of cells in a gas display panel has a somewhat lower voltage level which must be exceeded in order to maintain a cell once written. If the sustain voltage plus the wall charge falls below that minimum voltage level, the cell will extinguish. It is, therefore, necessary to position the sustain voltage at a level below the maximum sustain voltage allowable without writing unwritten cells and above the minimum sustain voltage allowable without extinguishing written cells. These voltage levels are different for each cell in a panel as shown in FIG. 1, and a window or margin of the sustain voltage represents a region of sustain voltage levels which satisfy all of the cells in the panel.

Figure 2:
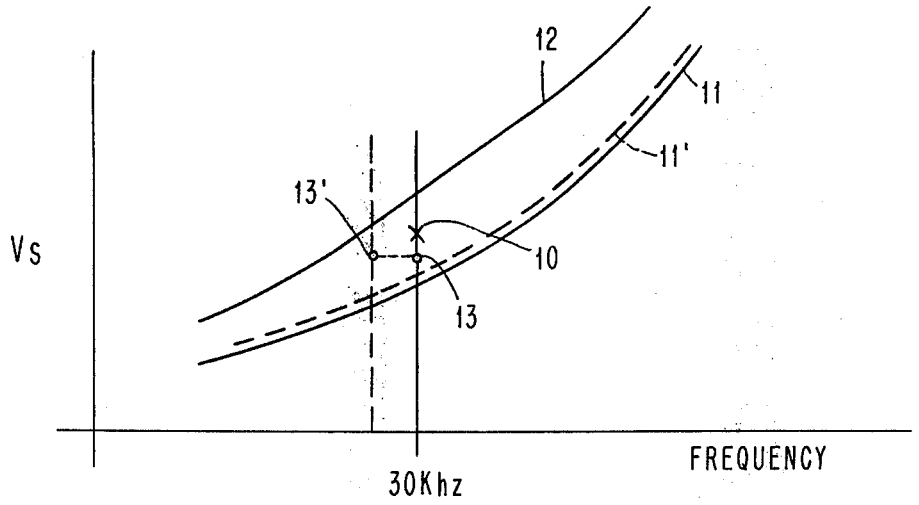
FIG. 2 is a graphical representation of the sustain voltage margin with frequency.

FIG. 2 is a graphic representation of the shifting of the margin as a function of frequency. In FIG. 2 a 30 KHz operating frequency has been selected and the operating level for sustain voltage has been set as shown at 10. The minimum sustain voltage level is shown at 11, and a maximum sustain voltage level is found at 12. Thus, FIG. 2 shows the operating voltage positioned at approximately the middle of the margin.

As the panel ages it has been found that the maximum sustain voltage levels may shift up or down. If the minimum voltage level 11 shifts upward to a position as shown at 11', it is clear that the margin between the operating voltage and the minimum sustain voltage has decreased. As the circuits which produce the operating sustain voltage age, the operating voltage has a tendency to drift. The drift may be downward as shown at 13. Thus, as the rising minimum sustain voltage level and the dropping operating voltage approach one another the expectation of panel failure increases. In order to provide for a longer panel life, the invention herein shifts the operating frequency as a function of shift in the operating voltage. Thus, the operating point 13 is shifted to 13', and in that manner the operating point is placed near the middle of the margin once again. In this manner there is compensation for the drift of the operating voltage and a resulting extension of the useable life of the gas display panel. The frequency shift must be empirically determined for each type of panel manufactured.

Figures 3, 4:
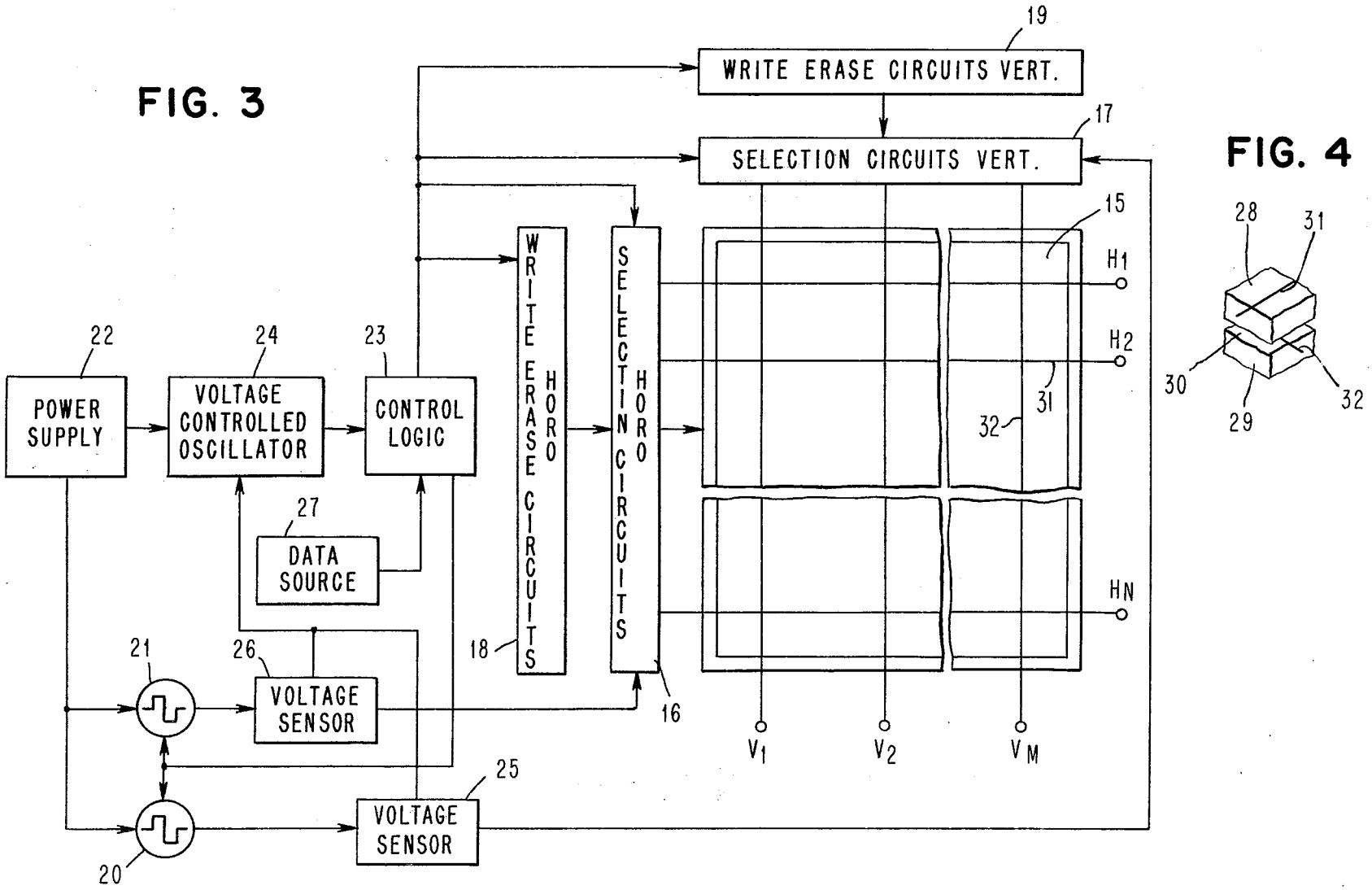
FIG. 3 is a circuit diagram showing the driving circuits for supplying sustain voltages to a gas display panel with the voltage controlled oscillator which sets the frequency.
FIG. 4 shows a sectional isometric view of a single cell and the conductors therein.

FIG. 3 is a diagram of the circuits which drive the sustain voltage through each of the orthogonal conductors in the panel. The panel is shown at 15 with orthogonal conductors $H_l$ through $H_n$ and $V_l$ and $V_n$. The horizontal selection circuits are shown at 16, the vertical selection circuits at 17, the horizontal write-erase circuits at 18 and the vertical write-erase circuits at 19. A vertical sustain pulse generator is shown at 20, and a horizontal sustain pulse generator is shown at 21 with the power supply at 22. The frequency of oscillation which is produced by the generators 20 and 21 is set through the influence of control logic 23 and the voltage controlled oscillator 24. Voltage sensors are shown at 25 and 26 to determine the amplitude of the voltages applied by sustain generators 20 and 21. It should be noted, that the sensing circuits can instead sense the voltage drift of the power supply 22, if this is more economical. Should there be a drift in sustain voltages, the amount of drift is sensed and the voltage controlled oscillator changes the frequency of the pulse generation accordingly. A data source 27 which might be, for example, a keyboard is used to provide information to the control logic 23 as to which of the cells should be written or erased. Since the details of these circuits are well known in the art they have not been shown herein.

FIG. 4 shows in perspective the two glass plates 28 and 29 which are the major elements of the panel. The space 30 between the two glass plates is sealed at the edges of the panel and contains a suitable ionizing gas such as neon. The two orthogonal conductors 31 and 32 which crossover to form the cell are also shown in FIG. 4.

Thus, a circuit has been provided which is unchanged with the prior art except for the insertion of a voltage controlled oscillator in place of an ordinary oscillator and voltage sensors to supply a control voltage to the voltage controlled oscillator. These changes enable longer panel life as previously discussed by taking advantage of the slope in the margin curve shown in FIG. 2. Standard voltage sensing circuits and standard voltage controlled oscillators can be used to provide the desired control.

While the invention has been particularly shown and described with reference to the preferred embodiment thereof, it will be understood by those skilled in the art that the foregoing and other changes in form and details may be made therein without departing from the spirit and scope of the invention.

What is claimed is:

1. In a gas display panel comprising a plurality of light emitting cells formed at crossover points of two orthogonal sets of conductors and means comprising a sustain voltage generator for each of said two sets of conductors for applying an alternating polarity sustain voltage of predetermined amplitude and frequency between said two sets of conductors to sustain an ionized condition in said cells, said sustain voltage having operable values of amplitude between a minimum amplitude to sustain a previously ionized cell and a maximum amplitude to not ionize a previously erased cell, said minimum and maximum values having a predetermined approximately linear, positive, relationship to frequency of the sustain voltage, wherein the improvement comprises, a voltage controlled oscillator and means connecting said oscillator to said means for applying said sustain voltage to establish the frequency of said sustain voltage, means for deriving a voltage representative of said sustain voltage amplitude, and means for changing the controlling voltage of said voltage controlled oscillator in response to said voltage that is representative of said sustain voltage amplitude to change the frequency of the sustain voltage according to said relationship of said minimum and maximum sustain amplitude values to sustain voltage frequency in the event that the amplitude of said sustain voltage drifts.

2. The gas panel of claim 1 wherein said means for changing the controlling voltage of said voltage controlled oscillator comprises a voltage sensor connected to receive said sustain voltage.

3. The gas panel of claim 2 wherein said means for changing the controlling voltage of said oscillator comprises two separate voltage sensors for said two sustain voltage generators and means connecting said two voltage sensors to control the frequency of said voltage controlled oscillator.

* * * * *